US007543462B2

(12) United States Patent
Miyamoto

(10) Patent No.: US 7,543,462 B2
(45) Date of Patent: Jun. 9, 2009

(54) YARN FEEDER OF YARN FEEDING DEVICE FOR WEFT KNITTING MACHINE

(75) Inventor: Masaki Miyamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 11/630,103

(22) PCT Filed: Jun. 14, 2005

(86) PCT No.: PCT/JP2005/010851

§ 371 (c)(1),
(2), (4) Date: Jun. 23, 2008

(87) PCT Pub. No.: WO2006/006335

PCT Pub. Date: Jan. 19, 2006

(65) Prior Publication Data

US 2008/0302137 A1 Dec. 11, 2008

(30) Foreign Application Priority Data

Jul. 7, 2004 (JP) ..... 2004-200779

(51) Int. Cl.
*D04B 15/56* (2006.01)

(52) U.S. Cl. ..... 66/126 A

(58) Field of Classification Search ..... 66/127, 66/125 R, 126 R, 128, 129
See application file for complete search history.

(56) References Cited

U.S. PATENT DOCUMENTS 4,738,124 A * 4/1988 Stoll et al. ..... 66/127
5,345,789 A * 9/1994 Yabuta ..... 66/126 A
6,021,651 A * 2/2000 Shima ..... 66/126 A
6,647,749 B2 * 11/2003 Ikoma ..... 66/126 A
6,988,385 B2 * 1/2006 Miyamoto ..... 66/127
7,096,694 B2 * 8/2006 Nakamori ..... 66/126 A
7,201,023 B2 * 4/2007 Okuno et al. ..... 66/126 R
7,272,959 B2 * 9/2007 Morita et al. ..... 66/127
7,353,668 B2 * 4/2008 Ikoma ..... 66/127
2004/0159126 A1 8/2004 Ikoma
2004/0211224 A1 10/2004 Miyamoto

FOREIGN PATENT DOCUMENTS

WO 02/079556 10/2002
WO 03/010378 2/2003

* cited by examiner

*Primary Examiner*—Danny Worrell
(74) *Attorney, Agent, or Firm*—Wenderoth, Lind & Ponack, L.L.P.

(57) ABSTRACT

A yarn feeder includes a switching mechanism which presets a swing direction of the yarn feeding port after completion of a yarn feeding operation, and, after having completed a yarn feeding operation, changes over the swing of the yarn feeding port from one yarn feeding position to another standby position interlocking with the released selective operation of an entraining device, in which the switching mechanism includes a feeder rod having a yarn feeding port at its lower end, which is composed of at least two members, both of the members being arranged to relatively slide each other in a vertical direction and provided with a push-up member to force upward respectively. The switching mechanism includes a support member for bearing the yarn feeding rod being provided with a regulation unit for regulating the upward movement of the yarn feeding port in the determined standby position, wherein the rise of the yarn feeding port in the standby position is limited below the determined altitude by using the regulation unit.

5 Claims, 10 Drawing Sheets

YARN FEEDER OF YARN FEEDING DEVICE FOR WEFT KNITTING MACHINE

TECHNICAL FIELD

The present invention relates to a yarn feeder of a yarn feeding device for a weft knitting machine, in which a yarn feeding port of the yarn feeder put on standby at an end portion of the knitting fabric or at a changed portion of the knitting pattern, for example, an intarsia knitting pattern, can be switched over to a position outside the fabric knitting region.

BACKGROUND ART

In general, a yarn feeder associated with a carriage to feed yarn to a needle in a needle bed for the knitting fabric is kept on a standby position outside the fabric knitting region.

In this case, the position of a yarn is lowered proportionately as the yarn feeder greatly moves beyond the boundary with the adjoining knitting area so that the yarn feeding condition can be improved.

Meanwhile, in case of an intarsia knitting operation, such a yarn feeder is released from the entraining device at a position exceeding the boundary with the boundary with the adjacent knitting region.

In the aforementioned structure of the yarn feeding device, it is considered that the amount of swing of the yarn feeder must be sufficiently increased correspondingly to the amount necessitated to retire a yarn extending between the yarn feeder that has stopped inside the adjoining knitting region and the knitted fabric to a position that does not cause any obstruction of the subsequent knitting operation in the next knitting region.

However, if the amount of swing of the yarn feeder is increased, a swinging mechanism of the yarn feeder becomes enlarged and complicated.

Accordingly, there has been proposed by the inventor of the present invention such a yarn feeder of a weft knitting machine, comprising a switching mechanism for switch-swinging the position of the yarn feeding port installed in a feeder case, the switching mechanism further comprising a pressing operation part switch-operating the swinging direction and altitude of the yarn feeding port in association, wherein the said yarn feeder is capable of obtaining the same effect as in a case in which the amount of swinging of a yarn feeder is substantially increased without increasing the amount thereof (See Patent Document 1).

Patent Document 1: International Publication WO02-079556

SUMMARY OF INVENTION

Problems to be Solved by the Invention

In the aforementioned proposal of a yarn feeder provided by the inventor of the present invention, the yarn feeding port of the yarn feeder moves vertically interlocking with a yarn feeding rod operated by an entraining device so that the yarn feeding port will be largely swung to the left or the right on its standby position and stop in a high position thereafter, and, as a result, the yarn drawn from the stitch at the end of the knitting region being pulled up. Therefore, there was such a problem that it may occur clogging of the stitch at the end of the knitting region and become very hard to form a uniform stitch therein.

Further, there was a fear that, if the yarn feeding port of the yarn feeder moved with a large amount of horizontal swing on the standby position and being kept in the high position, stitches are brought into free-lifting, and, upon transferring of the stitches, if the stitches being free-lifting, it is very hard to insert a yarn receiving needle into the free-lifted stitches, and, as a result, there happened a problem that transferring of the stitches could not be reliably performed.

Additionally, since the yarn feeding port of the yarn feeder must be moved sufficiently with a large amount of horizontal swing on the standby position and being stop in the high position, there has been a fear that the yarn will not reliably turn the back face of the needle in the stitch-transferring operation at the end of the knitted fabric or the width-increasing knitting operation.

The present invention has been proposed in consideration of the aforementioned problems. It is therefore an object of the present invention to provide a yarn feeder of a yarn feeding device used for a weft knitting machine, which is capable of producing a fabric having uniform stitches without the yarn free-lifting from the yarn feeder.

Method to Solve the Problems

In order to achieve the aforementioned object, a yarn feeder of a yarn feeding device used for a weft knitting machine according to the present invention, in which a plurality of yarn feeders which are engaged with and to be slide on knitting yarn guide rails arranged over a needle bed, an entraining means for entraining selectively any one of the yarn feeders and a switching mechanism for changing over the swing of a yarn feeding port provided at a lower end of a feeder rod between a yarn feeding position and a standby position interlocking with the operation of the entraining means, wherein before the selected yarn feeder through the operation of the entraining means having been entrained from a standby position to a yarn feeding position, the switching mechanism is operated so as to swing the yarn feeding port from the standby position to the yarn feeding position while, after having completed yarn feeding operation, the yarn feeding port being swung from one yarn feeding position to another standby position interlocking with the released selective operation of the entraining means, the yarn feeder being characterized in that:

the feeder rod is formed of at least two members, one being an upper member activated by the entraining means and another one being a lower member composed of a yarn feeding port at its lower end, both of the members being arranged to be relatively slide each other in a vertical direction and provided with a push-up member forced upward respectively; and the upper member of the feeder rod is moved downward through the action of the entraining means, as well as the lower member of the feeder rod downward so that the yarn feeding port is set into the yarn feeding position, while the feeder rod is moved upward into the standby position by means of a regulation unit provided on a support member bearing the feeder rod so as to keep the lower member from rising against the action of a force caused by the push-up member, and the rise of the lower member of the feeder rod is resultantly made less than that of the upper member to limit the rise of the yarn feeding port in the standby position below the determined altitude.

Additionally, a yarn feeder of a yarn feeding device used for a weft knitting machine according to the present invention is characterized in that a lower plate that forms the feeder rod comprises a yarn feeding port forming member, a spring storage member provided between the upper portion of the yarn feeding port forming member and a feeder rod guide, a compression spring that forms a depression member stored in the spring storage member, and a receiving portion that receives a lower end of the compression spring, wherein an abutment portion for abutting against a regulation unit is provided on an upper end of the spring storage members so as to rise the yarn feeding port forming port through a force caused by the compression spring.

Further, a yarn feeder of a yarn feeding device used for a weft knitting machine according to the present invention is characterized in that a slot is provided with at least either one of an upper end of the yarn feeding port forming member and a lower end of the spring storage member, through which a fixing element is inserted to be coupled to each other such as a height position of the yarn feeding port is adjustable by changing of coupling position. Additionally, a yarn feeder of a yarn feeding device used for a weft knitting machine according to the present invention is characterized in that a variable uppermost regulation position of the yarn feeding port can be adjusted by replacing the spring storage member having a different distance between a portion coupled to the yarn feeding port forming member and an upper portion abutting against the upper end of the spring storage member.

Effect of the Invention

According to the present invention, the feeder rod is formed of at least two members, one being an upper member activated by the entraining means and another one being a lower member composed of a yarn feeding port at its lower end, both of the members being arranged to be relatively slide each other in a vertical direction and provided with a push-up member forced upward respectively, and the upper member of the feeder rod is moved downward through the action of the entraining means, as well as the lower member of the feeder rod downward so that the yarn feeding port is set into the yarn feeding position, while the feeder rod is moved upward into the standby position by means of a regulation unit provided on a support member bearing the feeder rod so as to keep the lower member from rising against the action of a force caused by the push-up member, and the rise of the lower member of the feeder rod is resultantly made less than that of the upper member to limit the rise of the yarn feeding port in the standby position below the determined altitude. Therefore, the present invention resides not only in reliably obtaining the swing width of the yarn feeder but also in preventing from a larger altitude of the yarn feeding port in the standby position.

In this way, since the knitting yarn extended from the stitch of the end of the knitting region in the knitted fabric could be eliminated from oversized tension stress and clogging of stitch, it will advantageously lead to produce a knitted fabric having uniform stitches and high quality.

Moreover, unlike the generally employed case, the yarn feeder does not have to be largely slid to outside the knitting region, thus improving the productivity by reducing the sliding distance of the yarn feeder.

Additionally, in comparison with a conventional yarn feeder, even when the amount of swing of yarn feeders being in the same, the yarn feeding port in the present invention can be placed at a lower altitude. Therefore, even in case of a weft knitting machine of rough gauge or a needle-jumping-over knitting operation in which a large extent of swing of the yarn feeder is required, it can be advantageously kept in an ideal height apart from the yarn feeding port.

DETAILED DESCRIPTION OF THE INVENTION

An embodiment of a yarn feeding device for a weft knitting machine according to the present invention will be described referring to the drawings.

FIG. 1 is a lateral view of a weft knitting machine having a yarn feeding device including yarn feeders of the present invention, wherein a reference numeral 1 denotes the weft knitting machine in its entirety, and 2 denotes the yarn feeding device.

The weft knitting machine 1 has a pair of front and rear needle beds 3 disposed on a frame 4 in a fan shape with extreme ends thereof confronting each other, and each needle bed 3 has a plurality of knitting needles 5 thereon in parallel with each other so that they are movable back and forth.

A carriage 6 is disposed on an upper surface of each needle bed 3 so that it can be caused to reciprocate by a belt drive device (not shown). A bat 48 of each knitting needle 5 is operated by a knitting cam 7 attached to the carriage 6 as shown in the drawing so as to be advanced and retracted.

A gate arm (slide drive mechanism) 8 is mounted on the carriages 6 so as to stride over the front and back needle beds 3, and is integrally coupled with the carriages 6. Mounted on the gate arm 8 are a entraining device 10 that brings yarn feeders 9, and a push-down member 13 that pushes down yarn feeding ports 12 of the yarn feeders 9 to positions adjacent to each extreme end of the knitting needles 5 and 5.

Four knitting yarn guide rails 11 are elongated longitudinally over the needle beds 3 and arranged backward and forward over there in the form of a fan at the position in the radical direction apart from the center nearly close to the extreme one end of the knitting needles 5 disposed in parallel with each other on the needle beds 3.

The entraining device 10 includes transmission rods 15 for transmitting movement of output shafts of solenoids, which are projected and retracted in response to a signal output from a controller (not shown) to entraining pins 14 as shown in FIG. 2. The entraining pins 14 are forced downward by means of springs 16 engaged into engagement portions 19 which are formed respectively on a pair of right and left swinging pieces 18 disposed on a feeder case 17 of the respective yarn feeder 9 at portions adjacent to the center of upper end thereof. In this way, the yarn feeders 9 are fed by the entraining pins 14 (see FIG. 3).

The yarn feeder 9 is composed of a feeder case 17 supported by the knitting yarn guide rail 11 to be able to slide thereon, a feeder rod 20 provided with the yarn feeding port 12 at its lower end and suspended from the lower end portion of the feeder case 17, and a neutral position holding mechanism that hangs a feeder rod guide 21 for guiding the feeder rod 20 and holds the yarn feeding ports 12 in a neutral state at the standby position. An upper pivot portion of the feeder rod guide 21 is pivoted to the feeder case 17 to be able to swing horizontally.

The feeder rod 20 is formed of a slender sheet-shaped lower plate 22 whose right and left side edge portions are supported by the feeder rod guide 21 to be able to slide upward and downward, an intermediate plate 23 whose lower end portion is moveably coupled with an upper end portion of the lower plate 22, and an upper plate 25 whose lower end portion is coupled with the intermediate plate 23 through a push-down roller 24 projecting from an upper back surface of the intermediate plate 23. The push-down roller 24 is engaged with a lateral slot 26 formed at a lower end portion of the upper plate 25. An upper member of the yarn feeder 9 is composed of the upper plate 25 and the intermediate plate 23.

As shown in FIGS. 4-8, the lower plate 22 comprises a lower member which is composed of a yarn feeding port forming member 22*a* and a spring storage member 22*b* interposed in a portion above the yarn feeding port forming member 22*a* between the yarn feeding port forming member 22*a* and the feeder rod guide 21, compression springs 22*c* stored in the spring storage member 22*b* and a receiving member 22*d* for supporting the compressed springs 22*c* (urging portion), the receiving member 22*d* being engaged with an engagement hole 21*a* of the feeder rod guide 21. The spring storage member 22*b* is provided at the upper portion thereof with an abutment portion 22*e* abutting against a regulation portion 46 (described later) such that the lower plate 22 is forced upward by the compressed springs 22*c*.

The regulation portion 46 that abuts against the abutment portion 22*e* is formed of a dice-like member 47 fixed to be tightened to the feeder case 17 together with the feeder rod guide 21 through a sliding slot 23*a*.

Further, in the middle portion of the upper plate 25, coil springs 27 are mounted on the coil receiving portions 28 of the feeder case 17 with the middle plate 23 and the lower plate 22 so as to forcibly move the upper plate 25 vertically (see FIG. 7).

A switching roller 30 of a switching mechanism 29 for switching a position of the yarn feeding port 12 projects from a front surface of the intermediate plate 23 at an upper end portion thereof.

The switching mechanism 29 includes the switching roller 30, a regulation hole 31 formed through the feeder case 17 for regulating a swinging motion of the switching roller 30, and a selection lever 32 disposed on a back surface side of the regulation hole 31.

As shown in FIGS. 3 and 4, the regulation hole 31 is formed in substantially a trifoliate shape having spaces with which the switching roller 30 is engaged at the center, upper left and upper right portions thereof.

The selection lever 32 that sets an upward moving direction of the switching roller 30 confronting the regulation hole 31 is formed in substantially a T-shape with its upper end portion 32*a* formed in a gentle V-shape. The selection lever 32 is pivoted to the feeder case 17 at a pivot portion 32*b* at the center, which hangs down from a center of the upper end portion 32*a* and terminates in an arrow shape having oblique surfaces 34 and 34 on the right and left sides thereof for directing the upward moving direction of the switching roller 30. The intermediate portion between the oblique surfaces 34 and 34 has a roller receiving portion 35 that receives the switching roller 30 in a neutral position.

A holding means 36 for holding the switched positions of the selection lever 32 is disposed at an upper portion of an arrow-shaped portion formed of the two oblique surfaces 34 and 34 and the neutral position holding means.

The holding means 36 is arranged such that mustache-like elastic portions 37 are extended in both horizontal directions from an upper portion of the arrow-like portion, and gripping portions 38 and 39 are formed by bending portions near extreme ends of the elastic portions 37. Further engaging projections 40 are formed on a back surface of the feeder case 17 such that any one of them is engaged with any one of the gripping portions 38 and 39 when the selection lever 32 is turned to any one of the right or left position or the neutral position.

The neutral position holding mechanism 50 that holds the yarn feeding port 12 at the low neutral position adjacent to the knitting needle 5 while keeping the selection lever 32 in an upright state at the standby position is, as shown in FIG. 4, composed of pivot portions 51 and 51 each formed through the upper end portion of the feeder case 17 and a pair of links 53 having rotating portions 52 and 52 pivoted to the pivot portions 51 and 51 so as to be enabled to swing.

The pair of links 53 includes engagement portions 54 each having the extreme end portion engaged with each other at the center of the feeder case 17 in a horizontal direction. Protrusions 55 for operating the selection lever 32 into the neutral position by pushing up the upper end portion 32*a* of the selection lever 32 from the lower side are formed at the respective side surfaces that face with each other. Operation pieces 56 each extending to the left and the right from the rotating portions 52 are formed at the upper portion of the respective links 53.

The operation pieces 56 swung by the entraining pins 14 are formed to extend to the left and the right from the rotating portions 52, and have the upper surface oblique to be lower as it becomes closer to the engagement portion 54, and the outer end oblique downward. A reference numeral 57 denotes a plate of preventing dropout of the link 53.

The push-down member 13 that pushes down the feeder rod 20 is composed of a coupling plate 42 having one end coupled with the entraining pin 14 at an intermediate height position thereof, and a cam plate 43 having upper end portion coupled with another end of the coupling plate 42, whereby the cam plate 43 can be swung back and forth about a swing pivot pin 44 interlocking with up and down movement of the entraining pin 14 (see FIG. 2).

The entraining pin 14 is disposed on the middle of the cam plate 43 aside of the knitting yarn guide rail 11.

A reference numeral 46 shown in FIG. 4 denotes a brake unit formed of a magnet attracted to the knitting yarn guide rail. Since the yarn feeder 9 is reduced in size and weight, the yarn feeder 9 can be stopped at an accurate position even by a light sliding friction generated by an attracting force of the magnet.

Accordingly, unlike the generally employed yarn feeder, the present invention never causes the problem of unstable on stop position due to a large inertia force applied thereon, even if the yarn feeder interlocking with entraining device is stopped in a place, which fails to allow the yarn feeder to stop at the desired position. It is unnecessary to provide a special brake unit for stopping the yarn feeder at the desired position against the large inertia force.

Next, a description of operations performed by the yarn feeder 9 of the yarn feeding machine according to the present invention will be given.

As the carriages 6 are caused to travel on the needle beds 3 from right to left (direction shown by the arrow A in FIG. 3 and FIGS. 8-12) by the belt drive device in response to a signal output from the controller, the knitting needles 5 disposed in parallel with each other on the needle beds 3 are advanced and retreated by the knitting cams 7.

When the carriages 6 travel, in a portion where no knitting is executed, a solenoid is actuated responding to an output signal of pattern knitting operation so that the output shaft of the solenoid is projected downward and the entraining pin 14 of the entraining device 10 is moved upward against tension of a spring 16 through the transmission rod 15 thereafter.

As the entraining pin 14 is moved upward, the cam plate 43 of the push-down member 13 is lifted up about a swing pivot pin 44 (refer to the cam plate 43 at the right side in FIG. 2).

At a portion where knitting is performed, the solenoid is actuated in response to the signal output from the controller in front of a position where the carriage 6 confronts a predetermined yarn feeder 9 for supplying yarn to the knitting needles 5, and when the output shaft of the solenoid is receded upward, the entraining pin 14 moved upward is pushed downward by the tension of the spring 16. In association with this pushed-down operation of the entraining pin 14, the cam plate 43 of the push-down member 13 is swung toward the yarn feeder 9 about the swing pivot pin 44 through the coupling plate 42 (refer to the cam plate 43 at the left side of FIG. 2).

As the carriage 6 slides, the cam plate 43 pushes down the upper end portion (push-down portion) 25*a* of the upper plate 25 against a force caused by contraction of a coil spring 27, the switching roller 30 borne in the regulation hole 31 being guided downward to be centered in the lower portion of the regulation hole 31 and put on the descended position as shown in FIG. 9.

As the switching roller 30 through guidance of the regulation hole 31 descends to the middle of the lower portion in the regulation hole 30, the feeder rod guide 21 stands upright at the center of the feeder case 17 while projecting the yarn feeding port 12 of the feeder rod 20 downward from the lower end of the feeder rod guide 21, and the yarn feeding port 12 is located at a yarn feed position adjacent to the knitting needles 5 on a needle bed 3.

As the carriage 6 goes further away in the left side direction and subsequently the entraining pin 14 presses a projecting upper end portion 32*a* at a lower part (left side) of the selection lever 32, the selection lever 32 is swung counterclockwise about the turning center position of the pivot portion 32*b* from one status as shown in FIG. 9 to the other status as shown in FIG. 10. The position of the selection lever 32 is held because the left gripping portion 38, which forms a holding means 36, of the elastic portion 37 of the selection lever 32 is disengaged from the engaging projection 40, and because the right gripping portion 39 is engaged with engaging projection 41.

Thereafter, when the entraining pin 14 abuts against the engaging portion 19 of the swinging piece 18 located downstream of an advancing direction of the selection lever 32, the yarn feeder 9 is brought by the carriage 6, and yarn is fed to the knitting needles 5 from the yarn feeding port 12 of the yarn feeder 9. In this manner, the knitting operation is performed with the yarn fed from the yarn feeder 9 in the right knitting region.

When knitting operation of the determined knitting region having been finished and reached to the standby position outside the knitting region, the solenoid is energized in response to a signal output from the controller, in which the output shaft of the solenoid projects downward, the entraining pin 14 expanded downward being pushed up against the force caused by stretch of the spring 16.

As the entraining pin 14 is moved upward, the cam plate 43 of the push-down member 13 is swung to be lifted up about the swing pivot pin 44 in the state shown by the right side of FIG. 2.

When the entraining pin 14 having been moved upward and subsequently disengaged from the engaging portion 19 of the swinging piece 18 located downstream of an advancing direction of the carriage 6, the interlocked yarn feeder 9 is released. As a result, the cam plate 43 is lifted up and swung, the feeder rod 20 lowered up to that time begins to move upward, and, as a result, the yarn feeding port 12 in a lower end position is raised upward.

As aforementioned, when the yarn feeding port 12 ascends, the lower portion of the selection lever 32 resides in a position diagonally deflected on the right side as shown in FIG. 10 so that the switching roller 30 on its upper end is guided by the left side oblique surface 34 of the selection lever 32, and, therefore, the yarn feeding rod 12 ascends while it turning anticlockwise.

When the abutment portion 22*e* formed on the upper portion of the spring storage member 22*b* in the lower plate 22 abuts against the dice-like member 47, the yarn feeding port forming member 22*a* stops rising vertically opposed to a force caused by the compression spring 22*c* without exceeding the current latitude while only the intermediate plate 23 keeps ascending furthermore in response to a push-up force caused by the compression spring 27. Resultantly, the yarn feeding port 12 starts to swing on the right side with stopping its further ascending.

In comparison with an already known type of a yarn feeder constructed in solid from a push-down member to a yarn feeding port to be operated integrally, since the yarn feeding port of the yarn feeder of the present invention can be held at a lower altitude, upon changing a yarn feeder at a knitting boundary portion of a knitted fabric, for example, an intarsia knitted fabric, the yarn feeder is very far away from the boundary portion. In this way, it can make a yarn feeding machine to perform such an intarsia knitting operation without causing interference between the yarn feeders each other.

Next, it can be explained in connection with changing a yarn feeding port from the standby position to a yarn feeding position as follows. As the carriage 6 slides, the upper end 25*a* of the upper plate 25 is pressed down along an inclined portion at one end of the cam plate 43 in opposition to a force caused by the coil spring 27. At first, the upper plate 25 descends downward and next, the intermediate plate 23 starts to descend by means of the push-down roller 24 and the lower palate 22 starts to descend by means of the spring storage member 22*b* from the switching roller 30, and, as a result, the yarn feeding port 12 is changed in place of the yarn feeding position.

As shown in FIGS. 5-8, when the slot 65 formed through the yarn feeding port forming member 22*a* of the lower plate 22 being associated with a hole 66 formed through the upper end of the spring storage member 22*b* by means of fixtures 67, for example, bolts and nuts, it is capable of adjusting a position of the lower plate 22 by loosening the fixture 67 to be adjustable in a altitude of the yarn feeding port 12.

In addition, as described above, when such lower plate 22 is composed of a yarn feeding port forming member 22*a* and a spring storage member 22*b* and an abutting portion 22*e* is formed an abutting portion 22*e* at the upper portion of the spring storage member 22*b*, in which the upper limit of the rise of the yarn feeding port forming member 22*a* is easily changeable by replacing it with an abutting portion 22*e* having a variety height thereof and a desired upper limit of the yarn feeding port 22*a* is freely selectable in response to various gauges, a variety of knitting operation and so on.

In the Figure, the reference numeral 61 denotes a swing regulation unit, in which after having depressed the upper plate 25 in the position that is not influenced by the cam plate 43, that is, in the yarn feeding position, the protrusion 61*a* of the swing regulation unit 61 is inserted into the lower end of the slide slot 23*a* formed through the intermediate plate 23 and the swing regulation unit 61 is mounted by screwing the fixture 62 against the female screw 63 in the feeder case 17, and, as a result, the yarn feeding rod guide 21 can be constrained on its sides to regulate the swinging motion to be operated as a yarn feeder for the normal knitting.

REFERENCE NUMBERS

Figure 1:
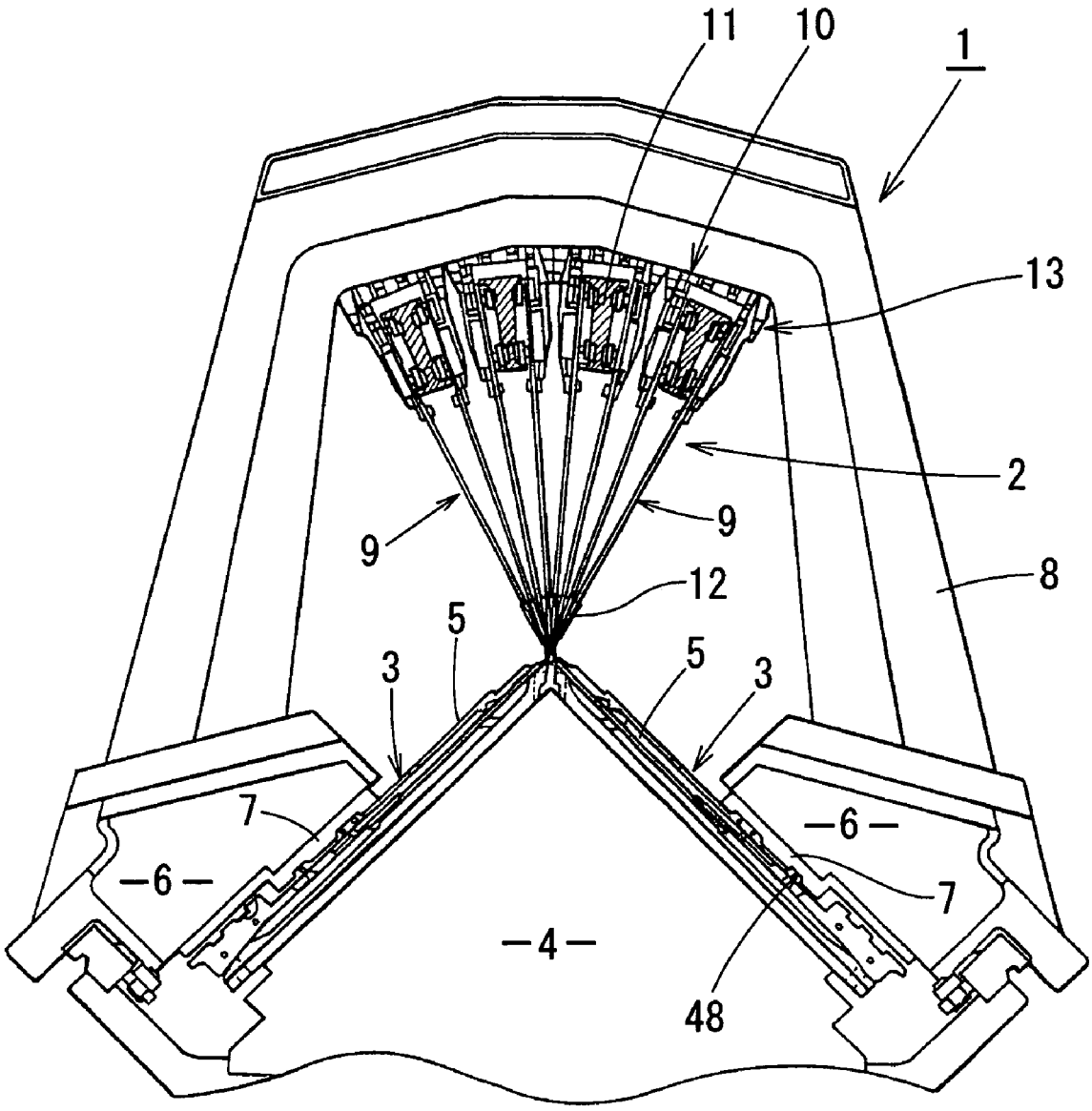
FIG. 1 is a side view in elevation of a weft knitting machine equipped with a yarn feed device including a yarn feeder according to the present invention.
Figure 2:
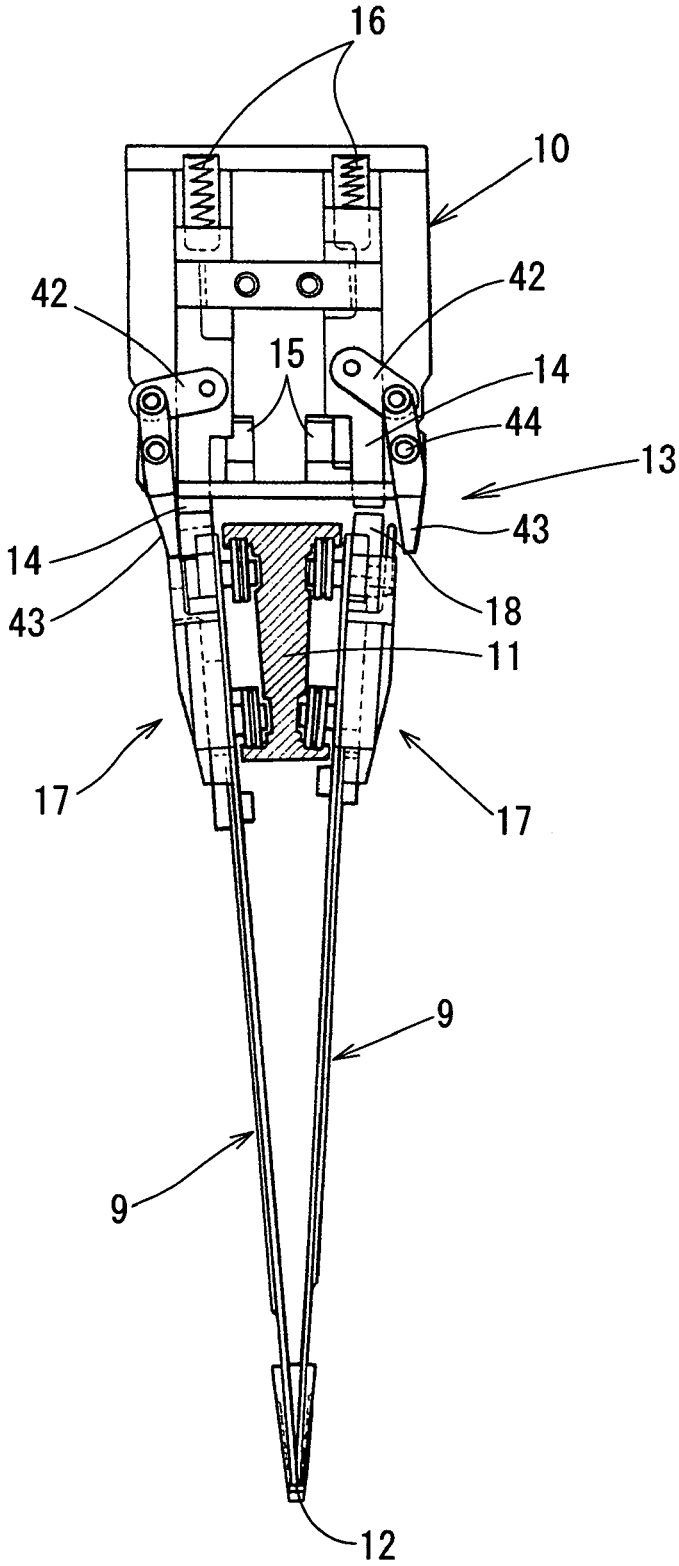
FIG. 2 is an enlarged view of the yarn feeder according to the present invention.
Figure 3:
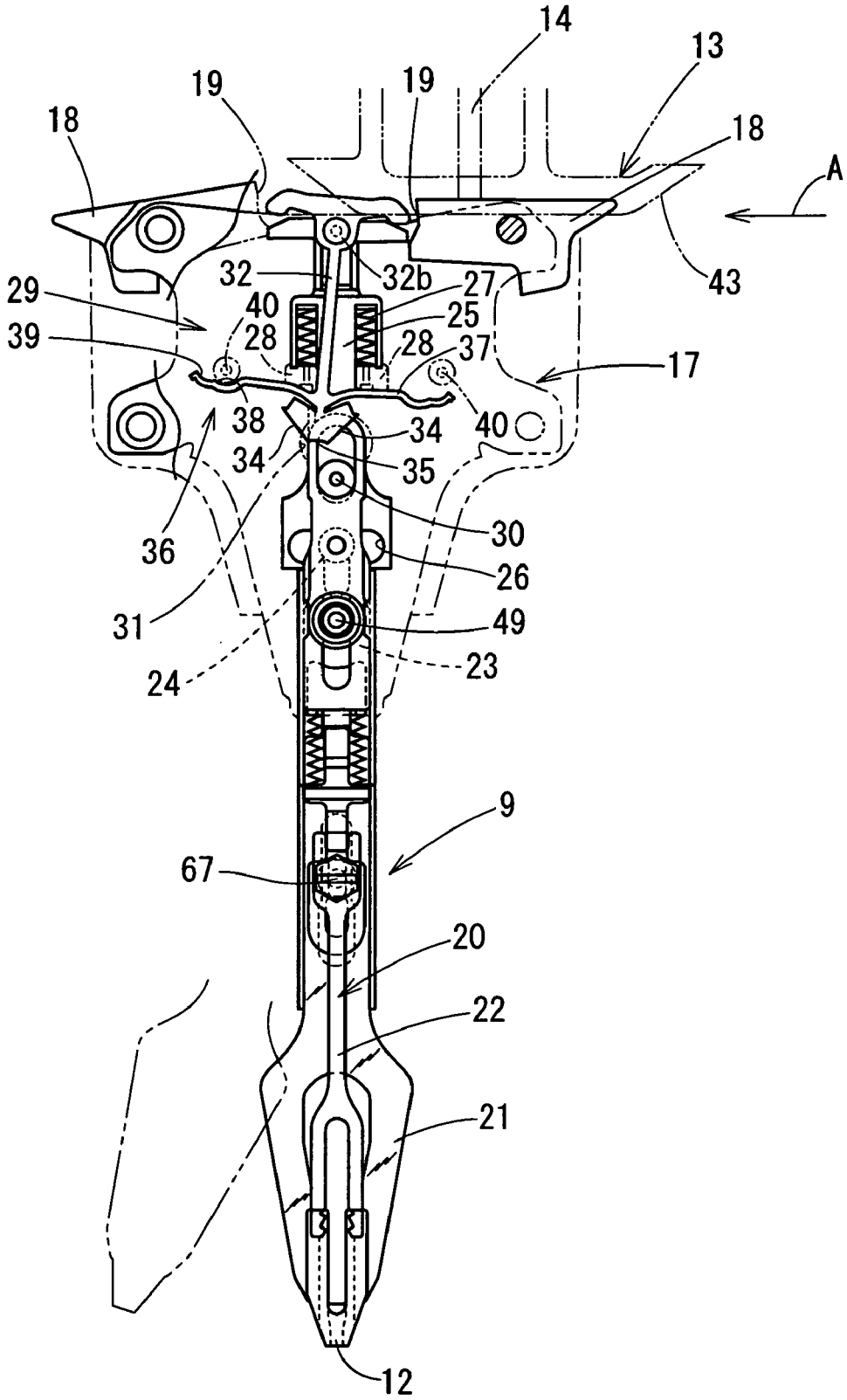
FIG. 3 is an explanatory view showing a mechanism of the yarn feeder of the present invention.
Figure 4:
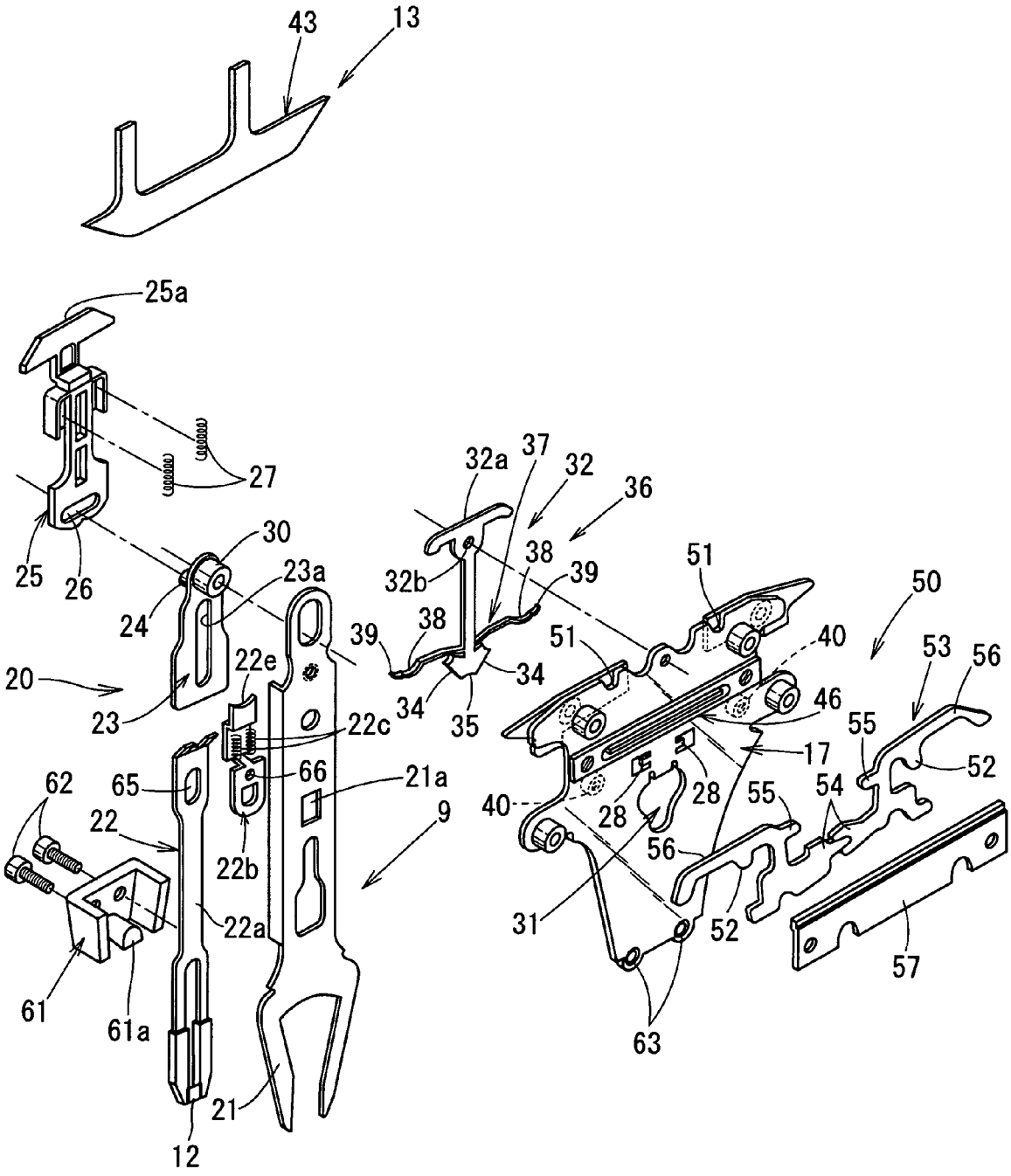
FIG. 4 is an exploded perspective view of the yarn feeder of the present invention.
Figure 5:
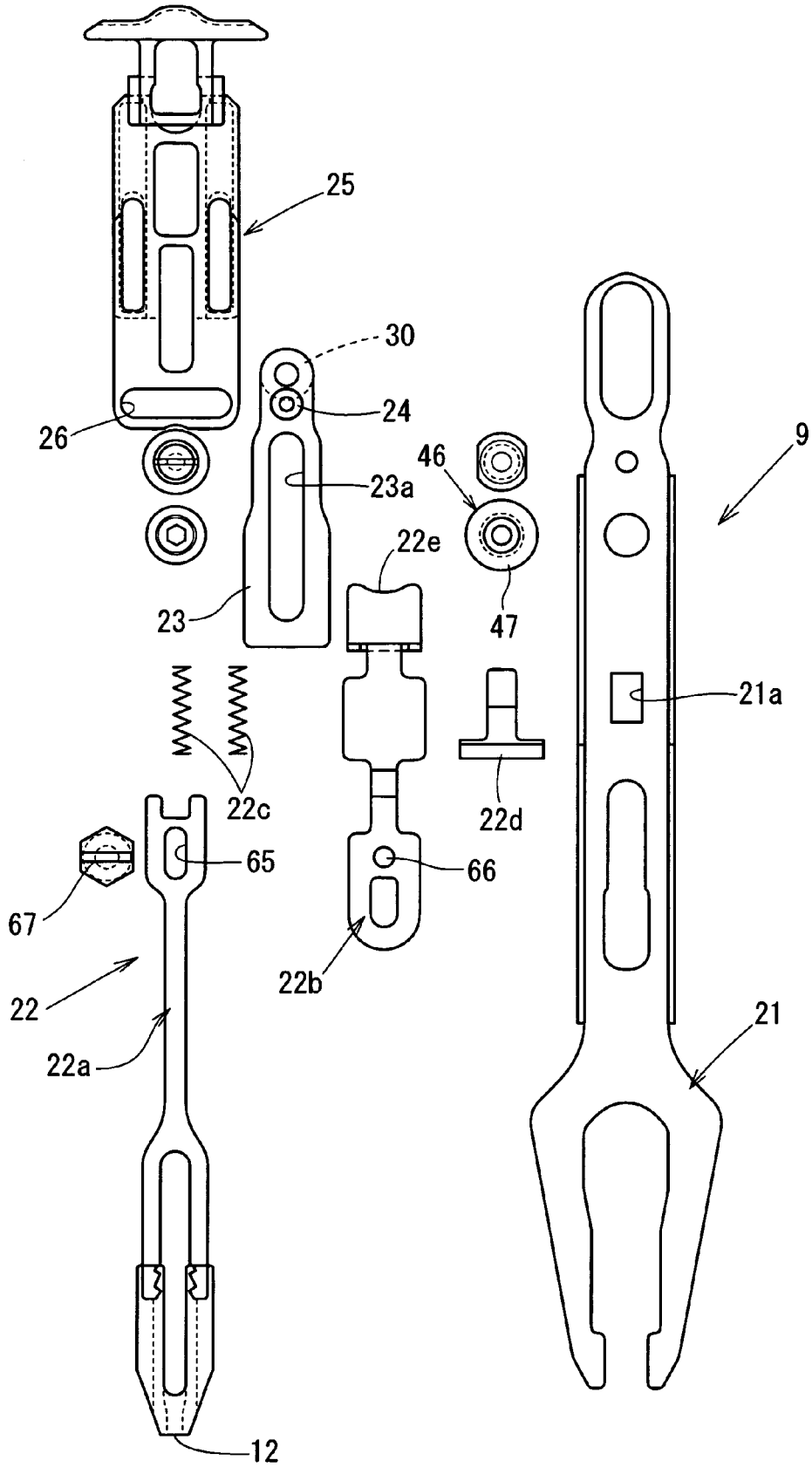
FIG. 5 is an exploded view of a feeder rod and regulation portion of the yarn feeder according to the present invention.
Figure 6:
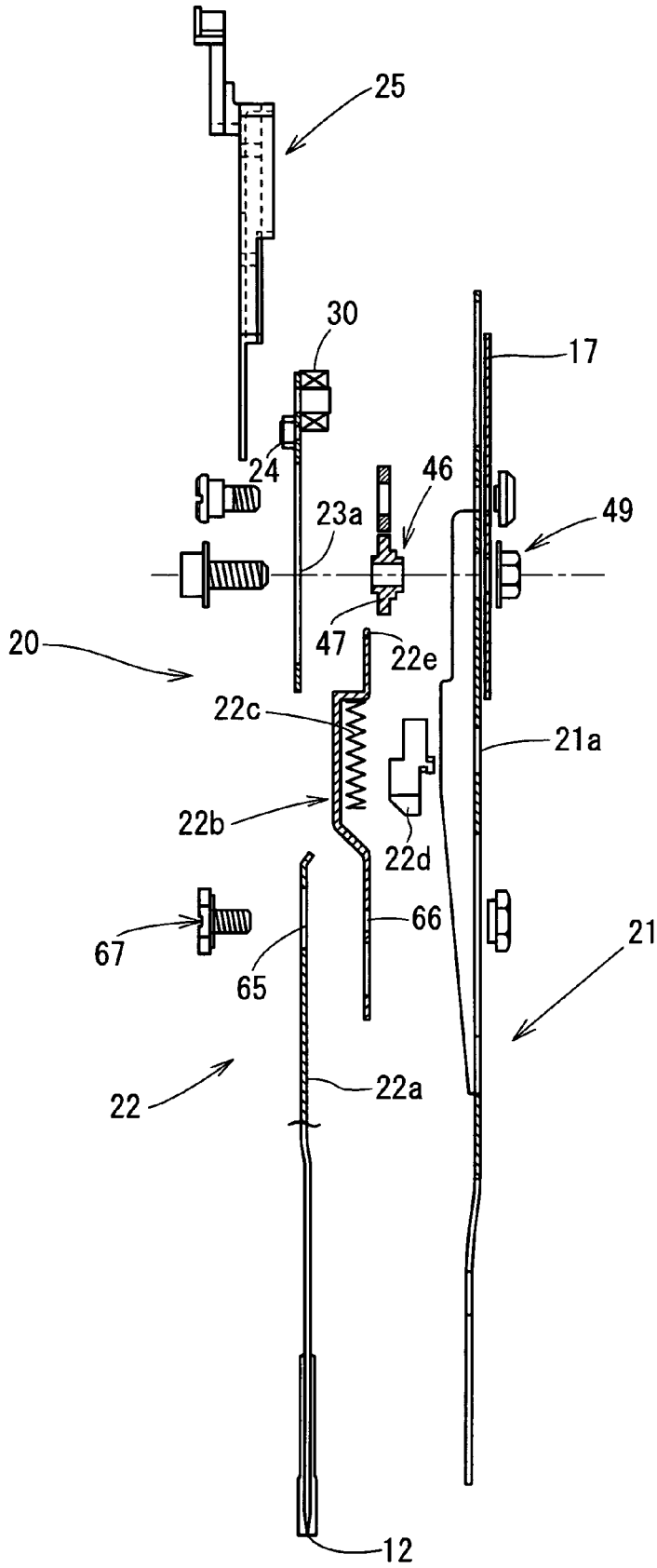
FIG. 6 is a partial vertical cross sectional exploded view of the feeder rod and the regulation portion of the yarn feeder according to the present invention.
Figure 7:
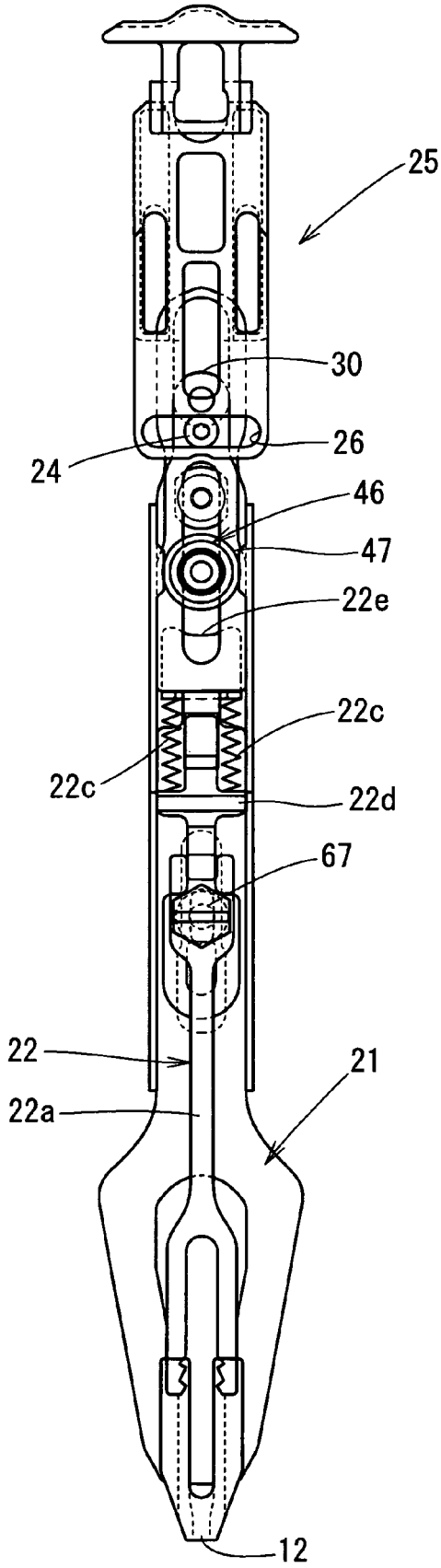
FIG. 7 is a front view showing the feeder rod and the regulation portion of the yarn feeder according to the present invention.
Figure 8:
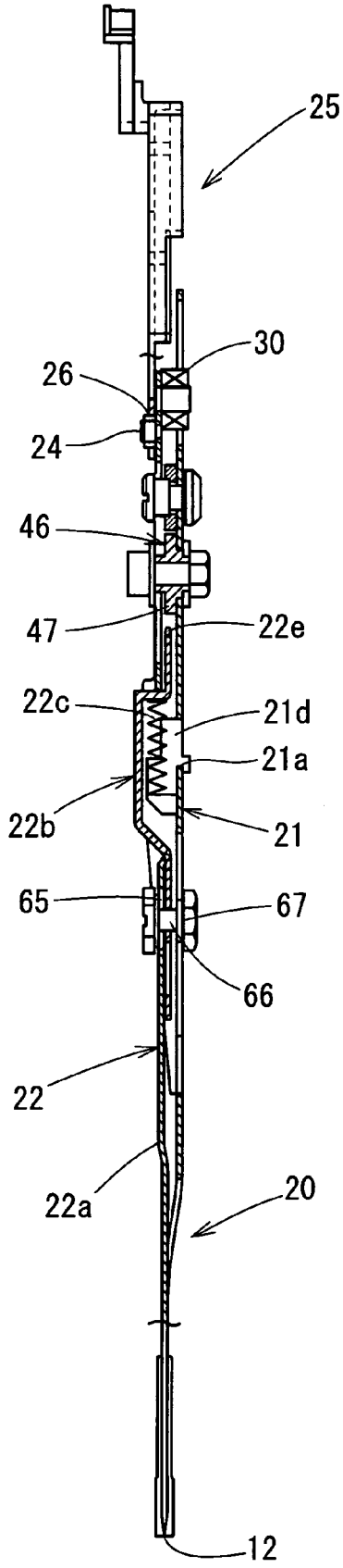
FIG. 8 is a partial vertical cross sectional view of the feeder rod and the regulation portion of the yarn feeder according to the present invention.
Figure 9:
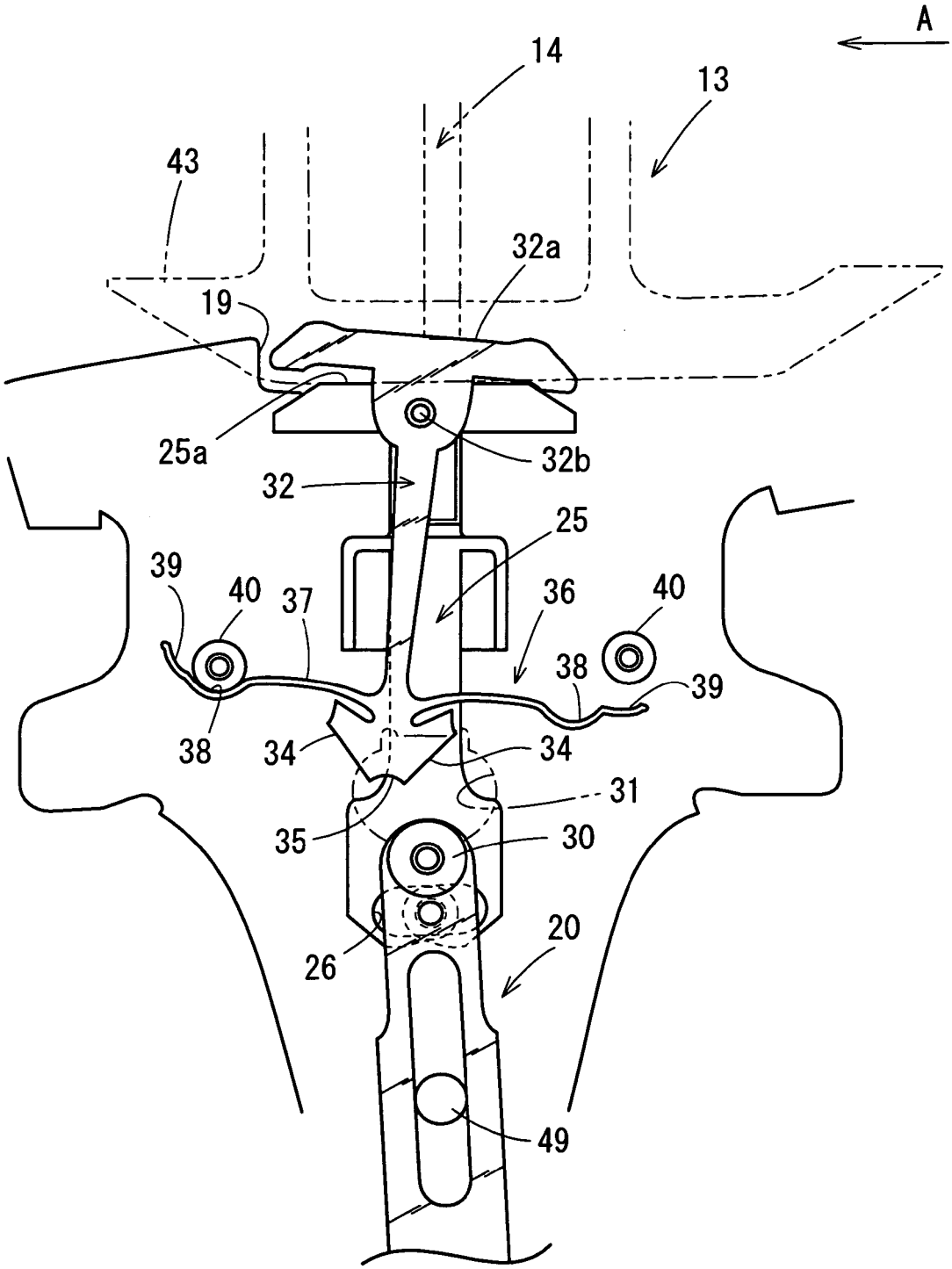
FIG. 9 is an explanatory view of the selection lever of the yarn feeder according to the present invention.
Figure 10:
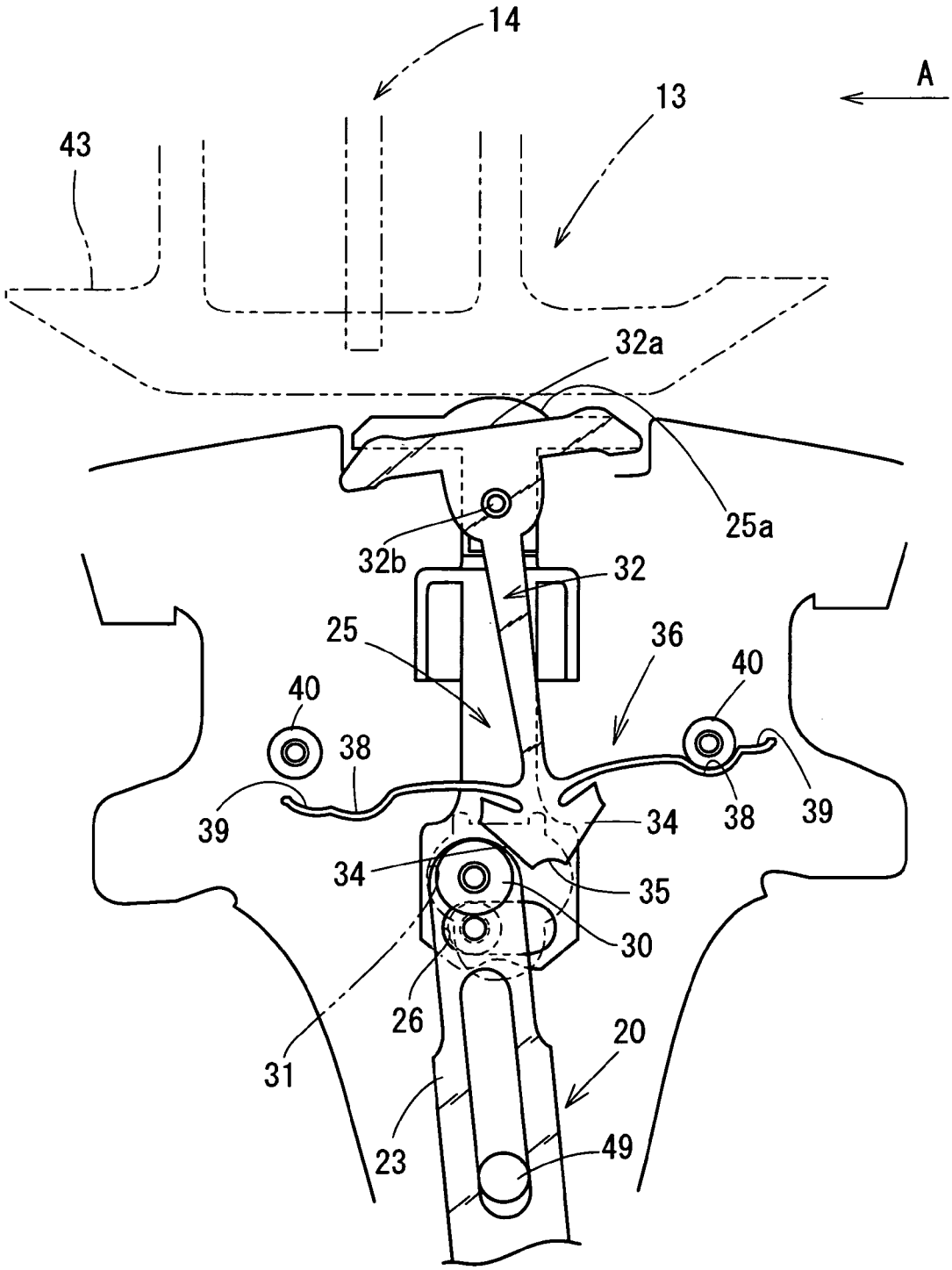
FIG. 10 is an explanatory view showing an operation of a portion that operates the selection lever of the yarn feeder according to the present invention.

3 NEEDLE BED
8 SLIDE DRIVE MECHANISM (GATE ARM)
9 YARN FEEDER
10 BRINGING DEVICE
11 KNITTING YARN GUIDE RAIL
12 YARN FEEDING PORT
17 FEEDER CASE
20 FEEDER ROD
22 LOWER PLATE
22*a* YARN FEEDING PORT FORMING MEMBER
22*b* SPRING STORAGE MEMBER
22*c* COMPRESSION SPRINGS(COMPRESSION MEANS)
22*e* ABUTMENT PORTION AT 22*b*
29 SWITCHING MECHANISM
32 SELECTION LEVER
65 SLOT FORMED THROUGH THE UPPER END OF 22*a*
66 HOLE FORMED THROUGH THE UPPER END OF 22*b*
67 FIXTURE

The invention claimed is:

1. A yarn feeder of a yarn feeding device used for a weft knitting machine, the yarn feeding device comprising:

a plurality of yarn feeders which are engaged with knitting yarn guide rails so as to be able to slide thereon, the knitting yarn guide rails being arranged over a needle bed;

an entraining means for entraining selectively any one of the yarn feeders; and a switching mechanism for changing over a swing of a yarn feeding port provided at a lower end of a feeder rod between a yarn feeding position and a standby position interlocking with an operation of the entraining means, wherein before the selected yarn feeder through the operation of the entraining means having been entrained from a standby position to a yarn feeding position, the switching mechanism is operated so as to swing the yarn feeding port from the standby position to the yarn feeding position while, after having completed a yarn feeding operation, the yarn feeding port being swung from one yarn feeding position to another standby position interlocking with a released selective operation of the entraining means, wherein the feeder rod is formed of at least two members, one being an upper member activated by the entraining means and another one being a lower member composed of a yarn feeding port at its lower end, both of the members being arranged to slide relative to each other in a vertical direction and provided with a push-up member forced upward respectively; and, the upper member of the feeder rod is moved downward through the action of the entraining means, and the lower member of the feeder rod is moved downward so that the yarn feeding port is set into the yarn feeding position, while the feeder rod is moved upward into the standby position by a regulation unit provided on a support member bearing the feeder rod so as to keep the lower member from rising against an action of a force caused by the push-up member, and a rise of the lower member of the feeder rod is resultantly made less than that of the upper member to limit a rise of the yarn feeding port in the standby position below a determined altitude.

2. A yarn feeder of a yarn feeding device used for a weft knitting machine according to claim 1, wherein a lower plate that forms the feeder rod comprises a yarn feeding port forming member, a spring storage member provided between an upper portion of the yarn feeding port forming member and a feeder rod guide, a compression spring that forms a depression member stored in the spring storage member, and a receiving portion that receives a lower end of the compression spring, wherein an abutment portion for abutting against a regulation unit is provided on an upper end of the spring storage member so as to rise the yarn feeding port forming port through a force caused by the compression spring.

3. A yarn feeder of a yarn feeding device used for a weft knitting machine according to claim 2, wherein a slot is provided with at least either one of an upper end of the yarn feeding port forming member and a lower end of the spring storage member, through which a fixing element is inserted to be coupled to each other such that a height position of the yarn feeding port is adjustable by changing a coupling position.

4. A yarn feeder of a yarn feeding device used for a weft knitting machine according to claim 2, wherein a variable uppermost regulation position of the yarn feeding port can be adjusted by replacing the spring storage member having a different distance between a portion coupled to the yarn feeding part forming member and an upper portion abutting against the upper end of the spring storage member.

5. A yarn feeder of a yarn feeding device used for a weft knitting machine according to claim 3, wherein a variable uppermost regulation position of the yarn feeding port can be adjusted by replacing the spring storage member having a different distance between a portion coupled to the yarn feeding port forming member and an upper portion abutting against the upper end of the spring storage member.

* * * * *